United States Patent [19]

Dismukes

[11] Patent Number: 4,484,641

[45] Date of Patent: Nov. 27, 1984

[54] TUBULARS FOR CURVED BORE HOLES

[76] Inventor: Newton B. Dismukes, 2952 Buttonwood Dr., Carrollton, Tex. 75006

[21] Appl. No.: 265,997

[22] Filed: May 21, 1981

[51] Int. Cl.[3] ..... E21B 7/04

[52] U.S. Cl. ..... 175/61; 175/74

[58] Field of Search ..... 175/61, 75, 73, 74, 175/320; 285/333, 264

[56] References Cited

U.S. PATENT DOCUMENTS

| | | | |
|---|---|---|---|
| 1,764,488 | 6/1930 | Zublin | 166/242 X |
| 1,781,049 | 11/1930 | Brinton | 175/320 X |
| 1,801,788 | 4/1931 | Zublin | 175/320 X |
| 1,886,820 | 11/1932 | Lee | 175/74 |
| 2,631,820 | 3/1953 | Zublin | 175/75 |
| 3,265,091 | 8/1966 | De Jarnett | 166/242 X |
| 3,663,043 | 5/1972 | Walton | 285/264 X |
| 4,143,722 | 3/1979 | Driver | 175/61 X |
| 4,240,652 | 12/1980 | Wong et al. | 285/333 X |

*Primary Examiner*—Stephen J. Novosad
*Assistant Examiner*—Michael Starinsky

[57] ABSTRACT

The invention provides a high strength, twist resistant tubular goods system for traversing highly deviated sections of well bores capable of conducting fluids under high pressures. The system comprises short pipe joints interconnected by unions capable of uni-directional mis-alignment. Buoyancy material is incorporated to reduce drag and minimize gouging the bore hole walls.

15 Claims, 16 Drawing Figures

$c = 2\sqrt{h(2r-h)}$

FIG. 12
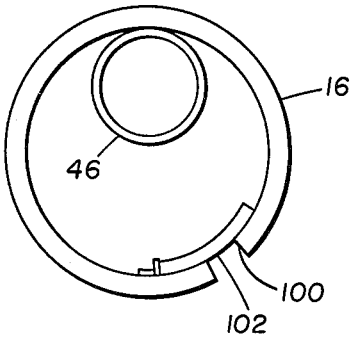
FIG. 11
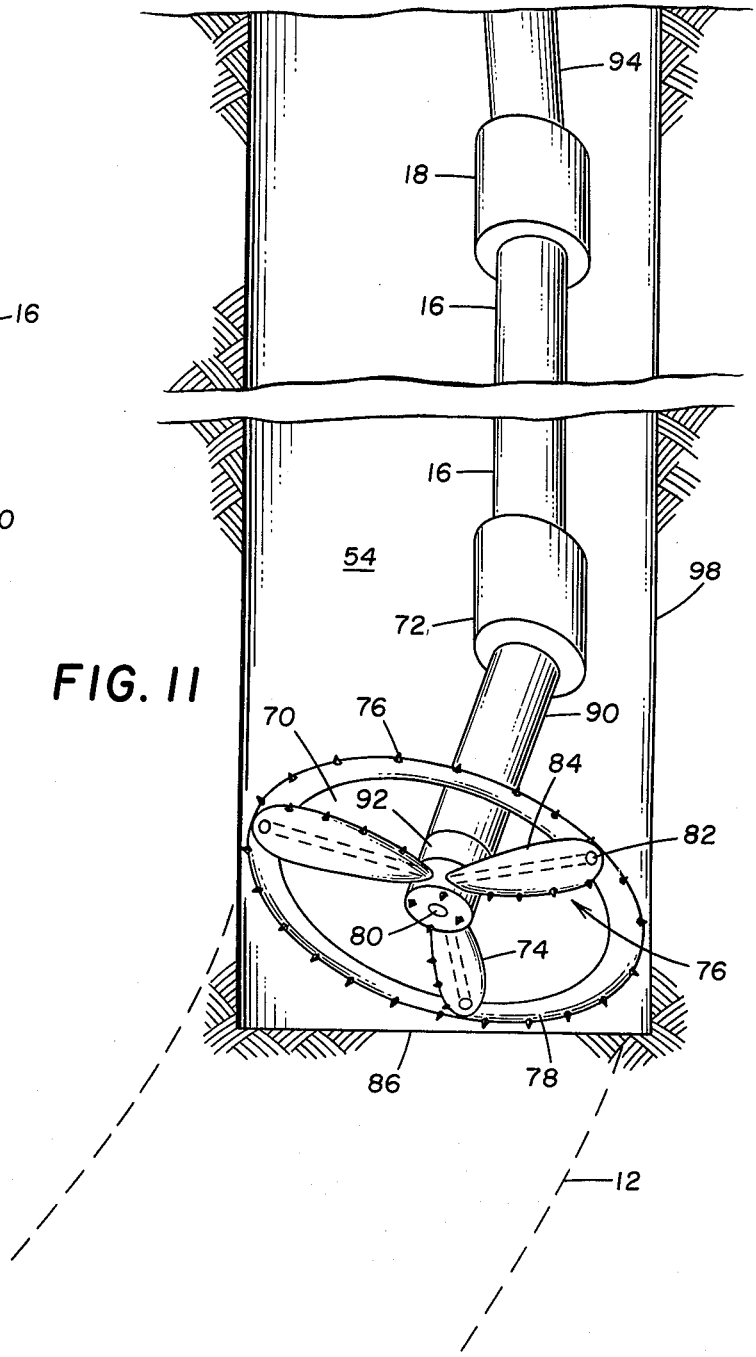
FIG. 14
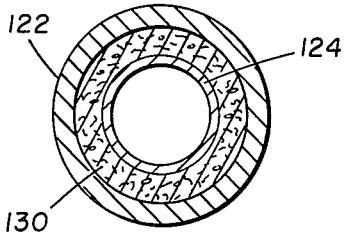
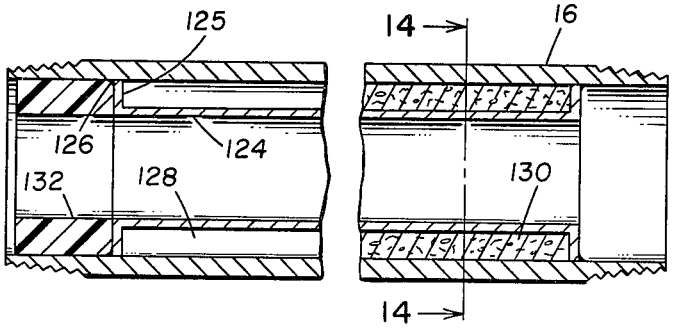
FIG. 13

TUBULARS FOR CURVED BORE HOLES

BACKGROUND OF THE INVENTION

This invention relates to tubulars for sharply curved bore holes, holes whose radius of curvature is too small for running the usual steel tubular goods. Since lateral bore holes from inaccessible wells desirably have a straight section extending beyond the curved portion, a shaft entering this section needs to straighten easily. Desired characteristics of such a tubular shaft include the capability of unidirectional bending, resistance to twisting, compatibility with the usual well fluids, good burst and collapse pressure specifications and neutral buoyancy in a drilling fluid to avoid bore hole wall drag due to the earth's gravity. The ability to withstand high temperature is also desirable in situations where the tubular shaft is to be used to conduct high temperature fluids in secondary oil recovery operations.

My co-pending application Ser. No. 125,240, filed Feb. 27, 1980, entitled "Method and Apparatus for Forming Lateral Passageways" relates to the formation of lateral passageways from inaccessible wells and the instant invention is applicable thereto.

DESCRIPTION OF THE PRIOR ART

The use of flexible hose in solution mining is disclosed in U.S. Pat. No. 2,251,916 to Roy Cross and U.S. Pat. No. 3,873,156 to Charles H. Jacoby. Several tools and schemes for drilling horizontal passageways from a vertical well are noted in the art. Typical of those which include a flexible conduit are U.S. Pat. Nos. 2,271,005 to John J. Grebe and U.S. Pat. No. 4,168,752 to Karol Sabol. U.S. Pat. Nos. 4,051,908, 4,143,722, and 4,227,584 issued to W. B. Driver include both a flexible tube arrangement and a downhole power source for drilling. Disclosed are flexible tube connections which have 360 degrees of freedom in flexing so that a drive system may be rotated in a curved bore hole. U.S. Pat. No. 1,850,403 to R. E. Lee discloses the use of a drill bit driven by a pneumatically powered motor to bore a deviated hole wherein the actuating gas is supplied to the motor through a flexible tube and the motor exhaust returned to a liner in the vertical portion of the well through a conduit consisting of lengths of tubing interconnected by ball joints. Periodically the drilling motor is stopped and the actuating gas vented through a special valve in the conduit to flush the cuttings out of the deviated portion of the hole. D. R. Holbert in Volume 49, Nos. 6 and 7 of the *Oil and Gas Journal* describes drainhole drilling utilizing "Wiggly" drill collars. The prior art, to my knowledge, does not disclose a tubular shaft having the desired and necessary characteristics enumerated above.

SUMMARY OF THE INVENTION

The radius of curvature of lateral bore holes extending from inaccessible wells desirably is smaller than can accommodate the usual steel oil country tubulars. The present invention involves the use of unions or couplings which flex to a limited degree in a single plane. Bending in but a single plane, rather than omni-swiveling, is important because it prevents rotation between pipe sections which could be caused by the reactive torque of a rotary boring tool. It should be appreciated that if a rotary bit driven by a downhole motor stalled, all of the torque developed by the motor would be transmitted to the shaft and any coupling or flexible tube connection would be subjected to that torque and could allow relative rotation between pipe sections. Also, limited flexing in a single plane prevents a shaft from gouging a bore hole wall or hanging-up on a ledge or wash-out when going into the hole. Because the mis-aligning unions permit only limited bending, a number of relatively short pipe sections may be required to traverse the small radius of curvature bore hole. For example, to enter a bore hole having a 90 degree arc with a radius of curvature of 40 feet, a conduit could be comprised of mis-aligning unions having a maximum bending of 10 degrees which join ten pipe sections having a total length of about 70 feet. This compares with a radius of curvature of about 1900 feet for the usual deviated hole which curves 3 degrees per 100 feet of depth. A change in angle of 10 degrees per 100 feet generally is considered to be a maximum for steel drill pipe. This is equivalent to a radius of curvature of 573 feet. My invention is useful in lateral or deviated bore holes wherein at least some portion has or will have a radius of curvature of less than 500 feet. It should be appreciated that smaller radii of curvature require shorter pipe sections and more unions.

Another advantage of using mis-aligning unions which flex in a single plane accrues when a conduit is used as a drill string. When the pipe length and unions are run in the hole they can be oriented, and will retain their orientation without relative twisting, and thus permit a lateral bore hole to be formed in any desired direction.

The high density of steel tubulars mitigates against their use in a horizontal or high deviated well because of drag. A lighter material such as plastic or a metal such as aluminum or a high strength light metal alloy may be used to form the pipe walls. Since either aluminum or the metal alloys are more dense than the usual well liquids, addition of buoyancy material less dense than the well liquid and preferably having an average density less than one gram per milliliter is required for neutral buoyancy to be established. Due to frequent rough contact with the walls of a bore hole buoyancy material preferably is placed inside the pipe. Cylinders, sealed at each end, containing a gas under pressure to resist collapse, and having a size and average density sufficient to overcome the weight of the pipe walls in the well liquid may be used to provide the needed buoyancy. Each length of pipe is fitted with a sealed buoyancy cylinder.

Unions capable of considerable mis-aligment are available from several manufacturers. The "HydroBall" connector, made by HydroTech Systems, Inc. of Houston, Tex., is a good example. It is fluid-tight and full-opening even with a 20-degree angle of mis-alignment. Since an important purpose for the use of the tubulars is to introduce fluids, typically drilling mud, into the nether and of the well bore, pressure resistant fluid sealing means is an essential requirement for the unions. An alternative flexible coupling for linking pipe sections consists of a sleeve of flexible plastic, such as nylon, fixed to the ends of the pipe lengths as by an adhesive. Sufficient space is provided between the pipe ends to permit the elastomeric sleeve to bend to the required angle. Twist is prevented by strips of metal spaced across the gap between pipe ends and slidably attached thereto. Both the elastomeric seals in the "HydroBall" and the sleeves may be made from a material such as Teflon or other temperature resistant sealing material to handle steam, for example, DuPont's Kalrez, a perflouroelastomer. The elastomeric sleeve may be reinforced by inclusion of strengthening fibers such as glass or carbon.

Stiffness in compression permits a conduit composed of, for example, aluminum pipe sections and a limited flexing union to be advanced by thrust or push from the end nearest the surface. It is necessary to limit the degree of bending of such unions to prevent over-flexing which could cause a hang-up when going into the hole, particularly at the depth where the lateral bore departs from the inaccessible well. An upper limit of not more than 30 degrees of bending of each mis-aligning union is preferable to prevent gouging of a bore hole wall. Enough downward push may be developed from snubbing at the surface or from the weight of an upper pipe section, possibly of steel to permit the use of a downhole motor for drilling. As is well known such motors may be powered electrically or by drilling fluid. Also, the instant invention may be used with the devices described in co-pending applications. Ser. Nos. 207,798 and 125,240 which disclose a source of advancing force located near the nether end of a conduit. Whatever the advancing force, a boring device, preferably a rotary bit, may be fitted to the system at its nether end.

In certain petroleum recovery operations it may be desirable to leave the conduit which has performed the service of a drill string, in the lateral bore along with its associated boring device. This would eliminate pulling the drilling conduit and running a 'casing' with the attendant cost in time and the danger of losing the lateral hole due to pipe sticking. For a thermal oil recovery system, steam may be circulated through the conduit in the same manner as drilling fluid. If after a heating cycle, it is desired to use the conduit as a production string, it is desirable to have the individual pipe sections pre-perforated. Such perforations may be sealed against loss of internal pressure by use of inside flapper valves which keep the perforations closed until external pressure becomes greater than internal pressure. A sand screen device may be incorporated into the flapper valve arrangement when needed to control entry of formation particles.

DESCRIPTION OF THE DRAWINGS

FIG. 11 shows a tubular of the instant invention and a hydraulically rotated and advanced boring tool.

FIG. 12 shows a means of utilizing pre-perforated pipe sections in a producing operation.

FIG. 13 shows a concentrically spaced buoyancy means.

FIG. 14 is a sectional view of the means of FIG. 13 taken along the line 14—14.

PREFERRED EMBODIMENTS

Figure 1:
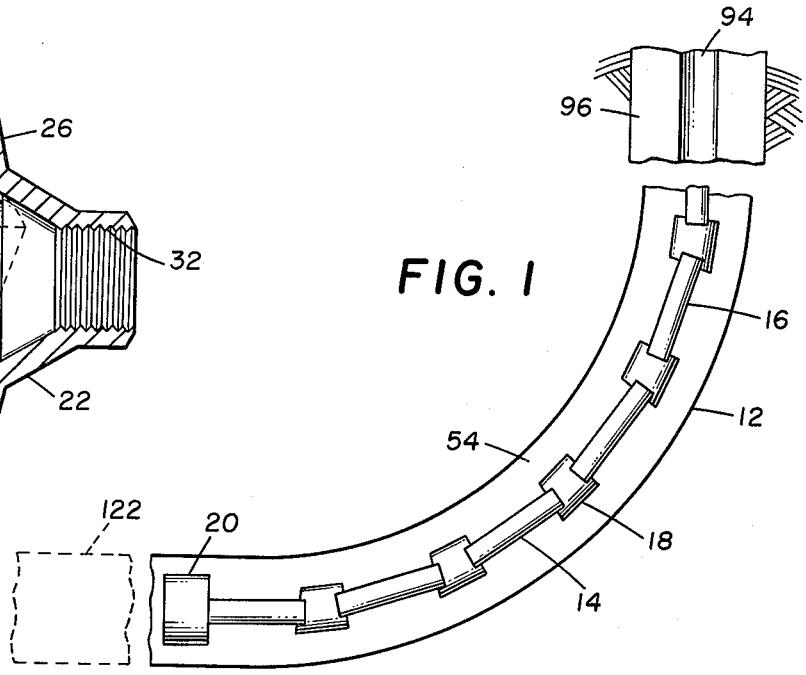
FIG. 1 shows, in schematic cross section, a conduit comprising sections of pipe jointed by mis-aligning unions in a curved bore hole.

A general view of the basic concept of the instant invention is shown in FIG. 1. A curved portion of a bore hole 12 is shown to have placed therein a fluid-tight conduit indicated generally by the numeral 14, composed of pipe joints 16 joined by mis-aligning unions 18. The numeral 20 indicates any of several devices such as a well logging device or a boring tool and a power source for generating thrust and torque affixed to the forward or nether end of the conduit for lowering into the desired working position in the bore hole.

Figure 2:
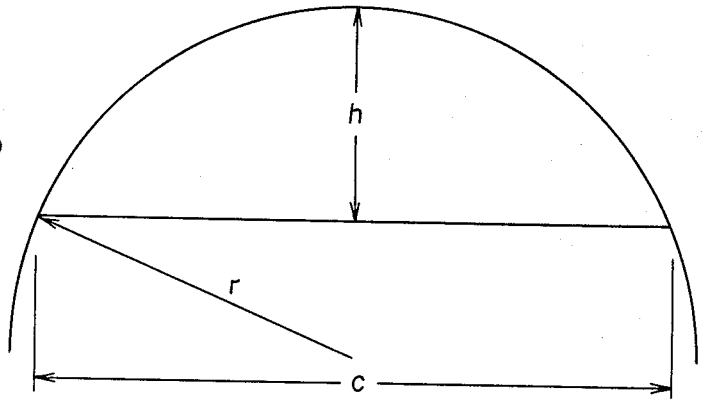
FIG. 2 illustrates the mathematical relationship between the length of a chord and the distance to the arc of the circle intersected thereby.

As shown in FIG. 2, the length of chord c connecting the ends of an arc in a circle having a radius r spaced a maximum distance h from the circle is given by the equation:

$$c=2\sqrt{h(2r-h)},$$

Figure 3:
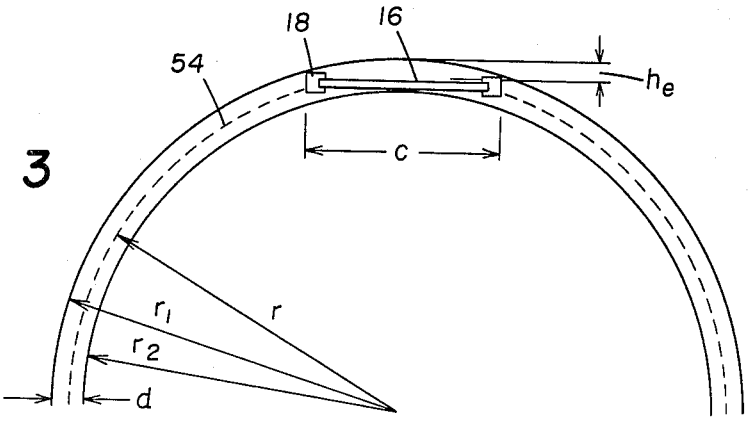
FIG. 3 illustrates the relationship between the length of a rigid pipe joint and diameter and radius of curvature of a well bore.

Hence, the maximum length c of a pipe joint 16 having couplings 18 at each end (FIG. 3) in a well bore having a radius r and a diameter d may be readily determined. For example, in a case where the radius of curvature is 40 feet (480 inches), the well bore diameter is 12 inches, the pipe and the couplings have external diameters of 6 inches and 8 inches respectively, $h_e$ (the effective distance between the pipe joint wall and the inside wall of the curved bore hole at the center of the joint and the walls of the unions at each end and the outer wall of the bore hole) will equal:

$$h_e = d_{hole} - \left[ d_{pipe} + \frac{d_{coupling} - d_{pipe}}{2} \right]$$

$$h_e = 12 - \left[ 6 + \frac{8-6}{2} \right]$$

Hence, in accordance with the equation above $$c=2\sqrt{5\times(960-5)}$$

$$c=138'' \text{ or } 11.5 \text{ feet.}$$

In the case assumed where the minimum radius of curvature to be traversed in the well bore is 40 feet, the length of the pipe joints preferably should not exceed 10 feet to minimize the risk of hanging up.

Generally, knowing the minimum radius of curvature of the well bore and its internal diameter from design plans and well bore hole surveys, the length of the pipe joints and couplings should be not more than about 90 percent of length c and not less than about 75 percent of c. Shorter lengths require a greater number of couplings and an unnecessary increase in cost. Greater lengths increase the risks of gouging or hang up that may be caused by non-uniformities in the well bore. This is particularly true where metallic pipe joints are used. Since some of the plastic pipe joints and reinforced plastic joints have more flexibility, lengths of such joints may approach c or even slightly exceed it to perhaps 110 percent of c without excessive risk.

Figure 4:
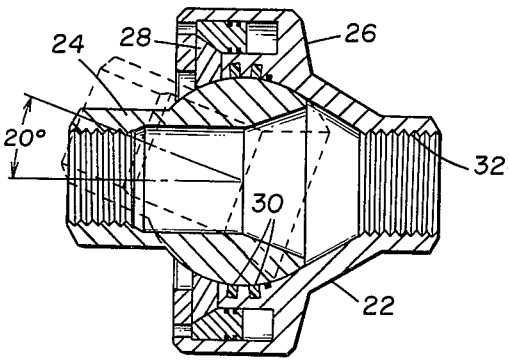
FIG. 4 is a cross sectional, enlarged view of one type of mis-aligning union used to connect adjacent pipe section ends.

FIG. 4 shows a mis-aligning union 22 which may be used to join a plurality of pipe lengths 16. It consists of a ball section 24 spaced inside socket 26 and held in place by retainer 28. Elastomeric seals 30 prevent leakage of fluids while permitting up to 20 degrees of mis-alignment. Union 22 may be fixed to pipe length 16 by means of a threaded connection 32.

Figure 5:
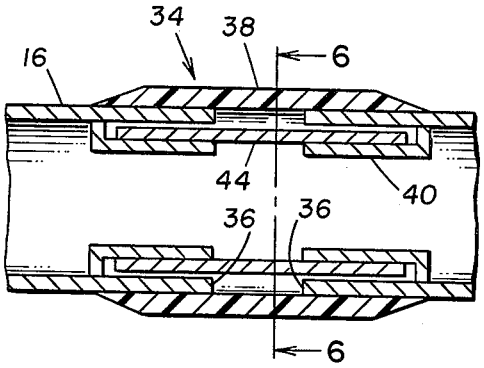
FIG. 5 illustrates another type of mis-aligning union which is twist resistant.
Figure 6:
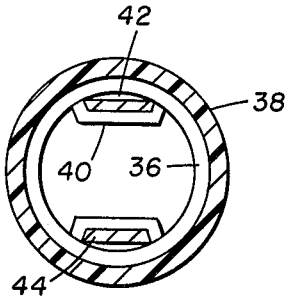
FIG. 6 is a cross sectional end view of the union shown in FIG. 5 taken along the line 6—6.

An alternative, non-twisting mis-aligning union is shown in FIGS. 5 and 6. Adjacent ends of pipe joints 16, denoted by the numeral 36, are coupled by a flexible plastic sleeve 38 which may be made of a heat-resistant material such as Teflon, or Kalrez, adhesively fixed to pipe 16 to form a fluid tight connection. Attached to the top and bottom interior pipe walls at each end of pipe lengths 16, as by welding, are metal forms 40 to form envelope 42 into which are fitted flat metal strips 44 to prevent relative rotation between pipe lengths 16 while permitting limited bending of union 34 in a direction normal to the flat sides of metal bar 44. Of course, the envelopes 42 in each pipe section 16 must be aligned to restrict bending to the desired single plane.

An internal buoyancy system for conduit 14 involves the use of a hermetically sealed cylinder 46, shown in FIGS. 7, 8, 9, and 10. The cylinder, which may be pressured by gas to resist collapse, is fixed to pipe joint 16 by a releasable attachment means 48 described later. Valve means 50 allows entry and release of pressuring gas 52 in much the same way as the valve on a pneumatic automobile tire. Pipe 16 and cylinder 46 may be of the same or dissimilar material. In any case, cylinder 46 is designed to provide flotation to conduit 14 to cause it to be neutrally buoyant in drilling fluid. The net buoyancy of cylinder 46 needed to equal the immersed weight of conduit may be calculated. To illustrate, an 8-inch diameter schedule 80 aluminum pipe, air weight 15 pounds per foot, is to be made neutrally buoyant in a 10 pounds per gallon drilling fluid. The immersed pipe will weigh 8.4 pounds per foot in the drilling fluid. The 4-inch, 1500 grade of TFP fiberglass pipe sold by Wilson Industries of Houston, Tex., when closed at each end and filled with air, has a net positive buoyancy of 9.2 pounds per foot when submerged in 10 pound per gallon drilling fluid. The excess buoyancy, 0.8 pounds per foot, of buoyancy cylinder 46 would tend to support the weight of union 34 in the drilling fluid. The resulting conduit 14 thus may be made neutrally buoyant in drilling fluid.

It should be appreciated that when neutrally buoyant pipe sections 16 are combined with mis-aligning unions which flex only in a single plane, such as union 34, pipe sections 16 should be aligned precisely in that plane to allow flexing without unduly stressing metal bars 44. Conduit 14 should be oriented as it is run into a bore hole.

Figure 9:
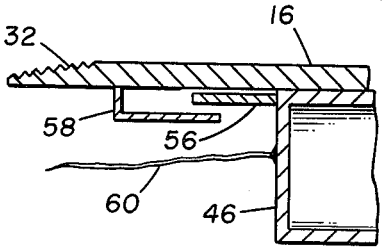
FIG. 9 shows a nether end latching arrangement for fitting a buoyancy cylinder inside a pipe section which is releasable.
Figure 10:
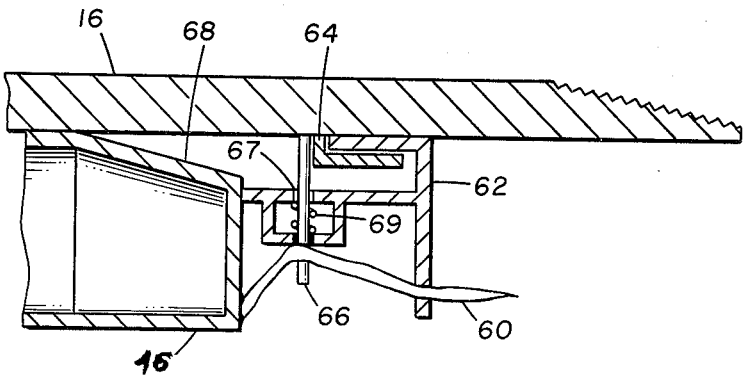
FIG. 10 similarly shows a near end latching arrangement.

Releasable means for attaching buoyancy cylinder 46 to pipe section 16 is shown in detail in FIGS. 9 and 10. At the nether end of cylinder 46 is attached a male member 56 which fits slideably inside female envelope 58 fixed to pipe 16 thus preventing relative movement between pipe 16 and cylinder 46 except in a direction parallel to the axis of each. A flexible line 60 loosely connects cylinders 46. The near end of each cylinder 46 is fitted with a hook-shaped extension member 62 which slideably enters an envelope 64 fixed to the inside of pipe section 16. A latch 66, which is spring loaded, is fitted through a port 67 in extension 62 so that tension in line 60 raises latch 66 against spring 69, allowing cylinder 46 to be moved away from the nether end of bore hole 12. The passage of cylinder 46 below envelope 64 is aided by bevel 68 as shown in FIG. 10.

As mentioned earlier, the instant invention may be caused to enter an existing curved bore hole, or it may be used in forming such a bore hole. In the latter instance, as shown in FIG. 11 the nether end of the nethermost pipe section 90 has affixed thereto a boring means 70, including a bearing means 92 to permit rotation of means 70 with respect to pipe 90. Mis-aligning union 72 has a fixed angular relationship to the axis of pipe section 90 such that a curved bore hole having a desired radius of curvature may be formed. Boring means 70 is described in my co-pending application Ser. No. 207,798, filed Nov. 17, 1980, entitled "Rotary Earth Boring Tool". Basically, it comprises a marine screw propeller having blades 74 which carry cutting elements 76 as does ring 78. A water course 80 transmits drilling fluid 54 to the nether side of boring means 70. Expulsion of pressured drilling fluid through jet nozzle outlets 82, which face radially outward, imparts a tangential reaction force causing rotation of the propeller which develops an advancing force to cause forceful rotary boring contact between cutting elements 76 and the bore hole end 86. Thus, boring means 70 forms a curved extension of bore hole 98 as indicated by dashed line 12.

To form a bore hole having a radius of curvature of 40 feet, as mentioned earlier, requires angle building at a rate of 1.43 degrees per foot. Accordingly, boring means 70, is affixed to mis-aligning union 72 at the predetermined fixed angle. Union 72 is attached to pipe section 16 followed by another misaligning union and pipe section and so on until a sufficient length of conduit 14 has been inserted into bore hole 98 to form the desired length of curved hole. Thereafter, a drill string of ordinary pipe 94 may be used to lower means 70 to the bottom 86 of bore hole 98. Circulation of drilling fluid 54 through conduit 14 initiates rotation of propeller blades 74 and their associated cutting elements 76 and boring ensues. Drill string 94 is lowered while curved hole boring progresses, care being taken not to allow excessive compression to develop in pipe section 90.

Figure 7:
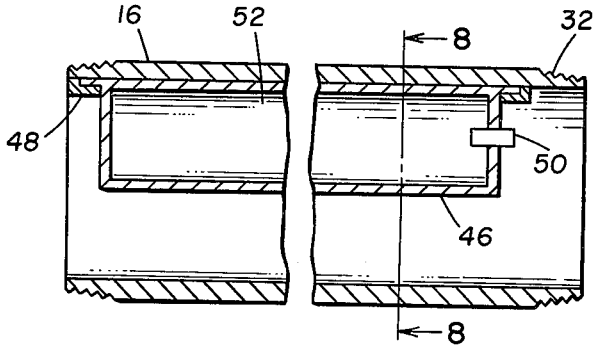
FIG. 7 is a cross sectional view of a buoyancy cylinder spaced inside a pipe section.
Figure 8:
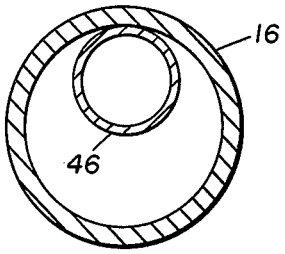
FIG. 8 is a cross section of FIG. 7 taken along the line 8—8.

It is preferred in the above-described boring operation to use neutrally buoyant pipe section 16 of the type shown in FIGS. 7 and 8. Curved borehole 12 may be formed in any desired direction by orienting conduit 14 and drill string 94 as they enter the hole as is standard practice in slant hole drilling. Direction and inclination of bore hole extension may be determined by usual survey methods.

Upon reaching the desired length of bore hole extension boring means 70 may be withdrawn. Then, a casing similar to conduit 14 may be set. Or, the entire drilling system may be left in the bore hole and oil production initiated through conduit 14. Also, steam may be injected through conduit 14 and out of water course 80 and jet nozzles 82 to heat a heavy oil before lifting it to the surface. Conduit 14, having been constructed of temperature resistant materials, is well suited to such thermal recovery operations. In other words, the instant invention contemplates forming an extension bore hole using a drilling system which does not depend upon the force of gravity and which includes a readily bendable conduit which may be left in the bore hole to facilitate various producing operations.

It may be preferred to remove buoyancy cylinders 46 before initiating producing operations. A pull on line 60 releases the nearest cylinder 46 from its attachment to pipe 16. Continued pull and recovery of line 60 releases the buoyancy cylinders sequentially outward whence they may be removed to the surface.

Pipe sections 16 may be perforated at the surface before being made up in conduit 14. FIG. 12 shows a pipe section 16 pre-perforated at 100 with flapper valve 102 closing the opening against fluid flow from the inside of the pipe, but opening readily to admit fluid into the pipe section 16.

In some instances it may be preferred to use an annular space to provide buoyancy effect. Also, an annulus may provide insulation as well as buoyancy, when steam is conducted through a central, concentric tube. FIG. 13 shows an exterior tube 122 enclosing an interior tube 124 having flanged ends 125 fixed to tube 122 at each end by weldment 126. The annular space 128 may contain a gas, or an insulating material 130 such as glass wool or a foam, or both. Additionally, or in place of the tube 124, an insulating, buoyant material, such as a syntactic foam 132 may be inserted inside exterior tube 122. As is well known in the art a protective film 134 may be applied to the interiorly exposed surfaces.

Figure 15:
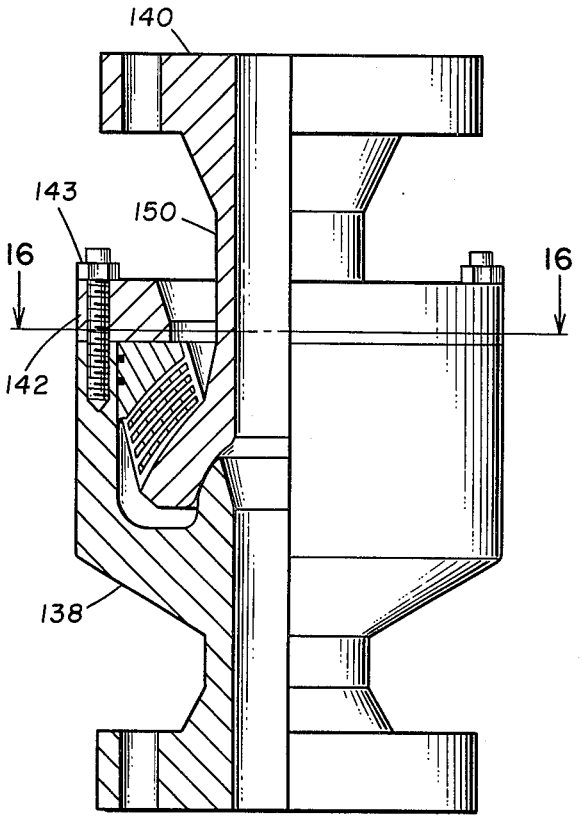
FIG. 15 shows another alternative type of mis-aligning union.
Figure 16:
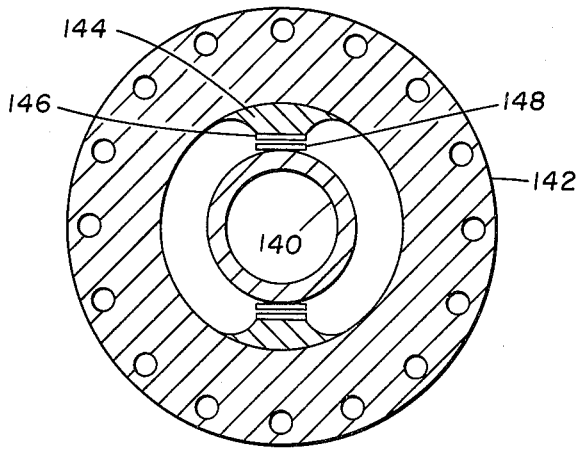
FIG. 16 is a horizontal section taken along the line 15—15 of FIG. 15 and shows the means for restraining the flexing to a single plane.

An alternative uni-directional, mis-aligning union 136 is shown in FIGS. 15 and 16. It is a modification of the "Lockseal" coupling manufactured by Murdock Machine and Engineering Company of Irving, Tex., 75061. It comprises a lower female member 138 which receives an upper, male member 140 and its associated sealing elements. The retention system 142 which is bolted to the female member maintains the upper and lower elements in operating relationship. To limit flexing between members 138 and 140 to a single plane, retention member 142, which is normally a hollow cylinder collar, is provided with interior shoulders 144 on opposite sides. Each shoulder is provided with a flat metallic face plate 146 which abuts flat metallic plates 148 fixed to the outer surface of the neck 150 of member 140 as shown in FIG. 16. Member 140 can, therefor, flex only in a direction substantially parallel to metallic plates 146 and 148.

Since many variations from and embodiments of the apparatus of this invention are within the scope thereof, it is to be understood that all matters set forth herein or shown in the accompanying drawings are to be interpreted as illustrative and not in a limiting sense.

I claim:

1. The method of drilling a deviated portion of a well bore having a minimum internal diameter $d_h$ and a minimum radius of curvature r to a desired direction normal to the vertical utilizing a rotary boring tool and actuating means having a diameter less than $d_h$ for causing said boring tool to rotate and for applying forward thrust thereto, a plurality of twist resistant, high strength pipe joints having an external diameter $d_p$ joined together by twist resistant unions capable of flexing only in a single plane and having a maximum external diameter $d_u$, wherein each pipe joint including associated unions has a maximum length c not greater than 1.1 times that length given by the following equation:

$$c=2\sqrt{h_e(2r-h_e)}$$

where $$h_e = d_h - \left[ d_p + \frac{d_u - d_p}{2} \right];$$

which comprises the steps of:

a. filling at least a portion of said bore hole with drilling fluid;

b. inserting into said bore hole a first pipe joint having affixed to the forward end thereof said rotary boring tool and said actuating means and a twist resistant union capable of flexing only in a single plane affixed to the rear end thereof, the length c of said first pipe joint, boring tool, actuating means and union being not greater than 1.1 times that length given by the above equation;

c. connecting a second pipe joint to the other end of said union;

d. continuing the alternate addition of unions and pipe joints until the total length of said pipe joints, including said boring tool and actuating means and said unions equals the length required to reach the desired destination;

e. adding and connecting additional pipe joints until said boring tool is at the depth where the hole is to be deviated;

f. directing said boring tool into the desired direction;

g. circulating drilling fluid through said connected pipe joints and unions; and h. activating the actuating means for rotating and advancing said boring tool.

2. The method of claim 1 in which the unions are provided with means for limiting the maximum amount of mis-alignment to not more than 30 degrees.

3. A method of deviating a bore hole to a desired position in the earth comprising the steps of:

a. filling at least a portion of said bore hole with drilling fluid;

b. inserting into said bore hole a rigid, twist resistant, high strength pipe joint having a rotary boring tool and means for causing said boring tool to rotate and for generating forward thrust affixed to the nether end of said pipe joint;

c. connecting a fluid tight, twist resistant union capable of mis-alignment only in a single plane to the near end of said pipe joint;

d. connecting a second pipe joint to the other end of said fluid tight union;

e. connecting a second fluid tight, twist resistant union capable of mis-alignment only in a single plane to the other end of said second pipe joint in such a manner that the plane of mis-alignment is substantially the same as the plane of mis-alignment of the first union;

f. continuing the alternate addition of pipe joints and unions capable of mis-alignment only in a single plane with the planes of mis-alignment of each union substantially the same as the plane of mis-alignment of the preceding union until said boring tool is at the depth where the bore hole is to be deviated;

g. directing said boring tool toward the desired position;

h. circulating drilling fluid through said connected pipe joints and unions; and i. activating the means for rotating said boring tool and applying forward thrust thereto to drill said deviated bore hole.

4. The method of claim 3 in which the unions are provided with means for limiting the maximum amount of mis-alignment to not more than 30 degrees.

5. The method of claim 3 wherein the minimum internal diameter of the deviated portion of the well bore is $d_h$, the minimum radius of curvature of the deviated portion of the well bore is r, the diameter of the rotary boring tool and actuating means is less than $d_h$, the external diameters of the pipe joints and unions are $d_p$ and $d_u$, respectively, both less than $d_h$, comprising utilizing pipe joints having a length c such that the length of each pipe joint and associated unions is not greater than 1.1 times that length given by the following equation:

$$c=2\sqrt{h_e(2r-h_e)}$$

where $$h_e = d_h - \left[ d_p + \frac{d_u - d_p}{2} \right].$$

6. The method of deviating a bore hole to a desired position in the earth comprising the steps of:

a. filling at least a portion of said bore hole with drilling fluid;

b. inserting into said bore hole a rigid, twist resistant, high strength pipe joint having a rotary boring tool and means for causing said boring tool to rotate and for generating forward thrust to said boring tool affixed to the nether end thereof;

c. connecting a fluid tight, twist resistant union capable of mis-alignment only in a single plane to the near end of said pipe joint;

d. connecting a second pipe joint to the other end of said mis-aligning union;

e. connecting a second fluid tight, twist resistant union capable of mis-alignment only in a single plane to the other end of said second pipe joint in such a manner that the plane of mis-alignment is substantially the same as the plane of mis-alignment of the first union;

f. continuing the alternate addition of pipe joints and unions capable of mis-alignment only in a single plane with the planes of mis-alignment of each union substantially the same as the plane of mis-alignment of the preceding union until the total length of said pipe joints and said unions equals the distance required to reach the desired position;

g. adding and connecting together additional pipe joints until said boring tool is at the depth where the bore hole is to be deviated;

h. directing said boring tool into the desired direction;

i. circulating drilling fluid through said connected pipe joints and unions; and j. activating the means for rotating said boring tool and applying forward thrust thereto to drill said deviated bore hole.

7. The method of claim 6 in which the unions are provided with means for limiting the maximum amount of mis-alignment to not more than 30 degrees.

8. The method of claim 6 wherein the minimum internal diameter of the deviated portion of the well bore is $d_h$, the minimum radius of curvature of the deviated portion of the well bore is r, the diameter of the rotary boring tool and actuating means is less than $d_h$, the external diameters of the unions and the pipe joints interconnected by the unions capable of mis-alignment in a single plane are $d_u$ and $d_p$, respectively, both less than $d_h$, comprising utilizing pipe joints having a length c such that the length of each pipe joint and associated unions is not greater than 1.1 times that length given by the following equation:

$$c=2\sqrt{h_e(2r-h_e)}$$

where $$h_e = d_h - \left[ d_p + \frac{d_u - d_p}{2} \right].$$

9. The method of claim 6 wherein the pipe joints are made of a metal selected from the class consisting of aluminum and light weight metallic alloys having buoyancy material jointed to the inner walls thereof to increase the buoyancy of the pipe joints when immersed in the drilling fluid.

10. The method of conducting a drilling operation through a curved portion of a bore hole comprising:

a. inserting into said portion a rigid, twist resistant, high strength pipe joint having a rotary boring tool and means for causing said boring tool to rotate and for generating forward thrust affixed to the nether end thereof and a fluid tight, twist resistant union capable of mis-alignment only in a single plane to the near end thereof;

b. inserting a second pipe joint connected to said union;

c. inserting a second fluid tight, twist resistant union capable of mis-alignment only in a single plane connected to said second pipe joint in a manner such that its plane of mis-alignment is substantially the same as the plane of mis-alignment of the first union;

d. inserting an additional pipe joint;

e. circulating drilling fluid through said pipe joints, unions and boring tool; and f. activating said boring tool to conduct said drilling operation.

11. The method of claim 10 in which the unions are provided with means for limiting the maximum amount of mis-alignment to not more than 30 degrees.

12. The method of claim 10 wherein the minimum internal diameter of the curved portion of the bore hole is $d_h$, the minimum radius of curvature of the curved well bore is r, the diameter of the rotary boring tool and actuating means is less than $d_h$, the external diameters of the pipe joints and unions are $d_p$ and $d_u$, respectively, both less than $d_h$, comprising utilizing pipe joints having a length c such that the length of each pipe joint and associated unions is not greater than 1.1 times that length given by the following equation:

$$c=2\sqrt{h_e(2r-h_e)}$$

where $$h_e = d_h - \left[ d_p + \frac{d_u - d_p}{2} \right].$$

13. The method of conducting a drilling operation through a curved portion of a bore hole comprising:

a. inserting into said portion a rigid, twist resistant, high strength pipe joint having a rotary boring tool and means for causing said boring tool to rotate affixed to the nether end thereof and a fluid tight, twist resistant union capable of mis-alignment only in a single plane to the near end thereof;

b. inserting a second pipe joint connected to said union;

c. inserting a second fluid tight, twist resistant union capable of mis-alignment only in a single plane connected to said second pipe joint in a manner such that its plane of mis-alignment is substantially the same as the plane of mis-alignment of the first union;

d. inserting an additional pipe joint;

e. circulating drilling fluid through said pipe joints, unions and boring tool; and f. activating said boring tool to conduct said drilling operation.

14. The method of claim 13 in which the unions are provided with means for limiting the maximum amount of mis-alignment to not more than 30 degrees.

15. The method of claim 13 wherein said pipe joints have an average density such that each pipe joint and its associated unions will be neutrally buoyant in the drilling fluid.

* * * * *